US007060012B2

(12) United States Patent
Howell et al.

(10) Patent No.: US 7,060,012 B2
(45) Date of Patent: Jun. 13, 2006

(54) SUBSTANTIALLY CONSTANT-FORCE EXERCISE MACHINE

(75) Inventors: Larry L. Howell, Orem, UT (US); Spencer P. Magleby, Provo, UT (US)

(73) Assignee: Brigham Young University, Provo, UT (US)

( * ) Notice: Subject to any disclaimer, the term of this patent is extended or adjusted under 35 U.S.C. 154(b) by 99 days.

(21) Appl. No.: 10/817,019

(22) Filed: Apr. 1, 2004

(65) Prior Publication Data

US 2004/0198571 A1 Oct. 7, 2004

Related U.S. Application Data

(60) Provisional application No. 60/460,471, filed on Apr. 2, 2003.

(51) Int. Cl.
*A63B 21/02* (2006.01)

(52) U.S. Cl. ..... 482/121

(58) Field of Classification Search ..... 482/121, 482/122, 123, 92, 30–32, 99, 74, 75, 77; 212/119

See application file for complete search history.

(56) References Cited

U.S. PATENT DOCUMENTS

| | | | | |
|---|---|---|---|---|
| 192,338 | A | 6/1877 | Marshall | |
| 3,708,167 | A | 1/1973 | Potgieter | |
| 3,981,500 | A | 9/1976 | Ryan | |
| 4,257,590 | A | 3/1981 | Sullivan et al. | |
| 4,620,704 | A * | 11/1986 | Shifferaw | 482/130 |
| 4,725,057 | A | 2/1988 | Shifferaw | |
| 4,848,740 | A | 7/1989 | VanDerHoeven | |
| 4,949,958 | A | 8/1990 | Richey | |
| 5,004,226 | A | 4/1991 | Brown, Jr. | |
| 5,029,850 | A | 7/1991 | Van Straaten | |
| 5,069,445 | A * | 12/1991 | Mai | 482/80 |
| 5,123,886 | A | 6/1992 | Cook | |
| 5,211,617 | A | 5/1993 | Millen | |
| 5,399,139 | A | 3/1995 | Malynowsky | |

(Continued)

OTHER PUBLICATIONS

Millar, A. J., Howell, L. L., and Leonard, J. N.; Design and Evaluation of Compliant Constant-Force Mechanisms; Proceedings of the 1996 ASME Design Engineering Technical Conferences and Computers in Engineering Conference, Aug. 1996; DETC2002/MECH-34206.

(Continued)

*Primary Examiner*—Stephen R. Crow
*Assistant Examiner*—Allana Lewin
(74) *Attorney, Agent, or Firm*—Thorpe North & Western

(57) ABSTRACT

A resistance module for an exercise machine for providing a substantially constant force through a range of motion includes at least one cantilever spring and at least one rigid member movable with respect to one another along a path of travel. The rigid member causes the cantilever spring to deflect and produce a resistance force. The cantilever spring has an anchored end and a deflection end. The rigid member engages the deflection end of the cantilever spring, and constrains the deflection end to a predetermined path of deflection as the cantilever spring and the rigid member move with respect to one another. The rigid member can be a non-planer contact surface along which the deflection end tracks, or a pivot link. The module can include means for operatively coupling at least one of the cantilever spring and the at least one rigid member to an exercise machine.

42 Claims, 8 Drawing Sheets

U.S. PATENT DOCUMENTS

| | | | | |
|---|---|---|---|---|
| 5,649,454 | A | 7/1997 | Midha et al. | |
| 5,813,953 | A | 9/1998 | Whipple | |
| 6,115,242 | A | 9/2000 | Lambrecht | |
| 6,123,557 | A | 9/2000 | Wang et al. | |
| 6,135,801 | A | 10/2000 | Helot et al. | |
| 6,149,554 | A * | 11/2000 | Ferguson | 482/83 |
| 6,719,671 | B1 * | 4/2004 | Bock | 482/75 |
| 2003/0232707 | A1 * | 12/2003 | Dalebout et al. | 482/123 |

OTHER PUBLICATIONS

Weight, B. L., Magleby, S. P., and Howell, L. L.; Selection of Compliant Constant-Force Mechanisms Based on Stress and Force Criteria; Proceedings of DETC '02 ASME 2002 Design Engineering Technical Conferences and Computers and Information in Engineering Conference, Sep., 2002; DETC2002/MECH-34206.

* cited by examiner

SUBSTANTIALLY CONSTANT-FORCE EXERCISE MACHINE

Priority is claimed from U.S. Provisional Patent Application No. 60/460,471, filed Apr. 2, 2003, which is hereby incorporated herein by reference.

BACKGROUND OF THE INVENTION

1. Field of the Invention

The present invention relates generally to exercise machines. More particularly, the present invention relates to substantially constant-force resistance modules for use in exercise machines.

2. Related Art

The value of resistance training has been recognized for many years. The goal of most resistance training exercises is to provide resistance to movement by a user such that the user's musculature is strained while displacing a load. So-called "free weights" are perhaps the simplest manner in which to provide this resistance, as a user can simply lift a weight while gravity acts on the mass of the weight to provide resistance to the user's motions. Because the force of gravity is sufficiently constant through a range of motion a human user can replicate, free weights can effectively apply a substantially constant resistance through the range of motion. While free weights are effective in providing a substantially constant force through a range of motion, free weights are necessarily heavy and often bulky, posing the risk of injury to a user and providing an exercise system that can be difficult to move and compactly store.

In addition to free weights, weight systems have been incorporated into machines which often have pulley and handle systems intercoupled to the weight system to allow a variety of resistance training exercises to be performed. Such exercise machines often have a "stack" of weights to which a take-off is provided to allow a user to adjust both the level of weight desired and the type of exercise desired, i.e., bench press, leg curls, etc. Exercise machines utilizing weight systems suffer from many of the problems associated with free weights in that the machines can be very heavy and difficult to move.

For these reasons, exercise machines have been developed that substitute springs or other resistant members for weight systems in an effort to streamline the exercise machine into a lighter and safer machine. Also, springs have been incorporated into exercise machines for use in low-gravity environments, where the gravitational force is sufficiently low as to negate the effectiveness of weight training.

While springs have been used with some success to simulate the resistance provided by free weights or weight systems, springs have also proved problematic as resistance members. This is because most springs generally provide a varying resistance to motion, that is, the force produced by a spring generally changes as the displacement of the spring increases or decreases. Thus, a user may encounter very high or low resistance as the range of motion is begun, and very low or high resistance, respectively, as the range of motion is completed. As the goal of most resistance exercises is to provide constant resistance through a range of motion, conventional springs have thus proved problematic as weight substitutes in exercise equipment.

SUMMARY OF THE INVENTION

It has been recognized that it would be advantageous to develop a resistance module for use in exercise machines that provides a substantially constant resistance force through a range of motion. In addition, it has been recognized that it would be advantageous to develop a resistance module that provides a substantially constant resistance force that can be oriented within an exercise machine in a variety of configurations.

The invention provides a resistance module for an exercise machine for providing a substantially constant force through a range of motion, including at least one cantilever spring and at least one rigid member movable with respect to one another along a path of travel. The rigid member causes the cantilever spring to deflect and produce a resistance force as the cantilever spring and the rigid member move with respect to one another along the path of travel. The cantilever spring has an anchored end and a deflection end. The rigid member engages the deflection end of the cantilever spring, and constrains the deflection end to a predetermined path of deflection as the cantilever spring and the rigid member move with respect to one another. Means can be included for operatively coupling at least one of the cantilever spring and the non-planar contact surface to an exercise machine.

In accordance with another aspect of the invention, a resistance module for an exercise machine for providing a substantially constant force through a range of motion is provided, including at least one cantilever spring and at least one rigid member, each being operatively restrained by at least one guide rail along a substantially linear path of travel with respect to one another. The rigid member causes the cantilever spring to deflect and produce a resistance force as the cantilever spring and the rigid member move with respect to one another along the linear path of travel. The cantilever spring has an anchored end and a deflection end. The rigid member engages the deflection end of the cantilever spring, and constrains the deflection end to a predetermined path of deflection as the cantilever spring and the rigid member move with respect to one another In accordance with another aspect of the invention, a resistance module for an exercise machine for providing a substantially constant force through a range of motion is provided, including a pair of opposing crossheads moveable with respect to each other along a path of travel, and at least one guide rail along which at least one of the pair of opposing crossheads moves along the path of travel. At least one rigid member is associated with one of the pair of opposing crossheads, and at least one cantilever spring is associated with another of the pair of opposing crossheads. The cantilever spring is engagable with the at least one rigid member as the pair of opposing crossheads move with respect to one another. The cantilever spring provides a substantially constant compressive resistance force between the crossheads in response to relative movement of the crossheads along the path of travel.

A method for providing a substantially constant force through a range of motion for exercising includes pulling an active member of an exercise machine through the range of motion. At least one cantilever spring is deflected through a range of deflection in response to pulling of the active member to produce a resistance force. The resistance force produced by the at least one cantilever spring is separated into 1) a first component that is substantially constant through the range of deflection, and 2) a second component that is substantially non-constant through the range of deflection. Only the first component of the resistance force produced by the at least one cantilever spring is operatively coupled to the active member of the exercise machine. The cantilever spring and a rigid member can be displaced relative to each other in a substantially linear path of travel in response to pulling of the active member. An angle of a force applied to the rigid member by a deflection end of the cantilever spring can change from a direction substantially parallel with the linear path of travel to a direction at an acute angle to the linear path of travel.

In accordance with another aspect, the invention provides a method for providing a substantially constant force through a range of motion for exercising, including the steps of: pulling an active member of an exercise machine through the range of motion; displacing at least one of a cantilever spring and a non-planar contact surface relative to each other in a substantially linear path of travel in response to pulling of the active member; and changing an angle of a force applied to the non-planar contact surface by a deflecting end of the cantilever spring from a direction substantially collinear with the linear path of travel to a direction at an acute angle to the linear path of travel.

Additional features and advantages of the invention will be apparent from the detailed description which follows, taken in conjunction with the accompanying drawings, which together illustrate, by way of example, features of the invention.

DETAILED DESCRIPTION

Figure 1:
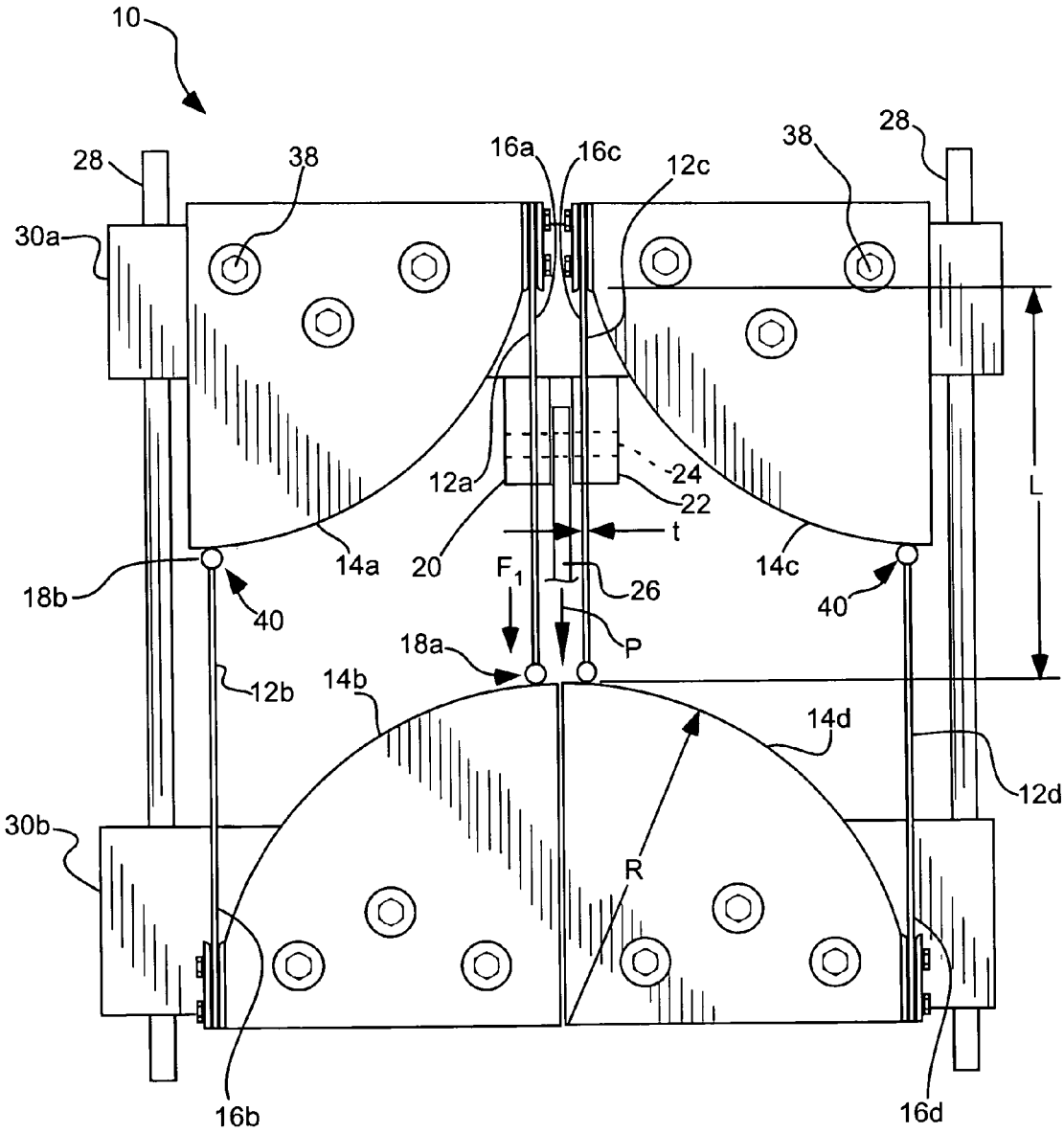
FIG. 1 is front view of a substantially constant force resistance module in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

The present invention provides one or more resistance modules for providing a substantially constant force through a range of motion for an exercise machine. Exercise machines, physical fitness, weight training, and health maintenance are examples of fields that can benefit from use of the present invention. For example, the module can be incorporated into an exercise machine 11, shown by way of example in FIG. 6. The exercise machine can have various different configurations, operations, etc. The exercise module can include a cantilever spring and a rigid member movable with respect to one another along a path of travel. The rigid member can include a non-planar contact surface or a pivot link, as described in greater detail below. The rigid member causes the at least one cantilever spring to deflect and produce a resistance force as the at least one cantilever spring and the at least one rigid member move with respect to one another along the path of travel. The rigid member engages a deflection end of the cantilever spring, and constrains the deflection end to a predetermined path of deflection as the at least one cantilever spring and the at least one rigid member move with respect to one another. In addition, the rigid member separates the resistance force produced by the at least one cantilever spring into 1) a first component that is substantially constant through the path of deflection, and 2) a second component that is substantially non-constant through the path of deflection. Means can be included for operatively coupling only the first component of the resistance force produced by the at least one cantilever spring to the exercise machine.

Figure 2:
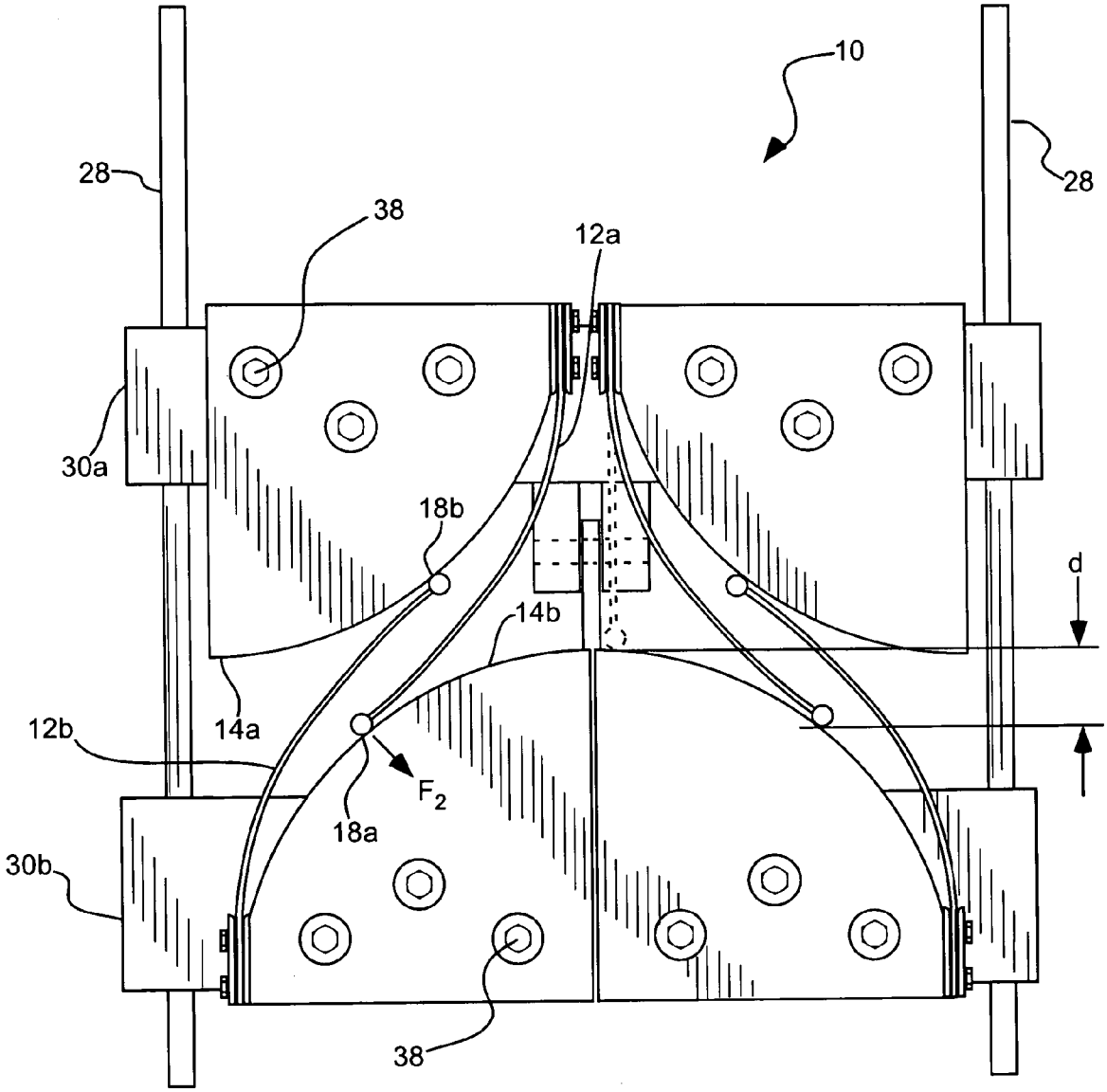
FIG. 2 is a front view of the resistance module of FIG. 1 shown in a displaced configuration.

As illustrated in FIGS. 1 and 2, one or more resistance modules, indicated generally at 10, in accordance with the present invention can be provided. The module 10 can include at least one cantilever spring 12*a* and at least one non-planar contact surface 14*b*. The non-planar contact surface 14*b* can form the rigid member described above. The non-planar contact surface 14*b* can be curved or arcuate, with a rounded or semi-circular shape. The cantilever spring and non-planar contact surface can be movable with respect to one another along a path of travel, shown generally at P. The path of travel P can be substantially linear, as discussed below. The cantilever spring 12*a* can be displaced towards the non-planar contact surface 14*b*, as shown in FIG. 2, along the path of travel P. Alternatively, the non-planar contact surface can be displaced towards the cantilever spring, or both can be displaced towards one another.

The cantilever spring can have an anchored end 16*a* and a sliding or deflection end 18*a*. The deflection end 18*a* can be engagable with, and can track along, the non-planar contact surface 14*b* as the cantilever spring 12*a* and the non-planar contact surface move with respect to one other along the path of travel P. The cantilever spring 12*a* can have an initial, substantially unstressed or non-flexed configuration in which the cantilever spring is oriented substantially parallel with the path of travel P. In addition, the cantilever spring 12*a* can be initially oriented substantially orthogonal to the non-planar contact surface 14*b* (although the deflection end 18*a* can engage the non-planar contact surface at a slight angle to facilitate movement of the deflection end along the contact surface in the proper direction).

As shown in FIG. 2, the cantilever spring 12*a* can be bendable as the deflection end 18*a* tracks along the non-planar contact surface 14*b* to produce a substantially constant resistance force in a direction of the path of travel P as the cantilever spring and the non-planar contact surface move with respect to one other along the path of travel. As the cantilever spring 12*a* bends, the deflection end 18*a* deflects. The curvature of the non-planar contact surface 14*b*, the cantilever spring 12*a*, and the path of travel P can define, and can be contained in, a plane or planar layer. As the cantilever spring 12*a* bends, it remains within the plane or planar layer. As described above, one or both of the cantilever spring and the non-planer support surface can be displaced towards one another. The term "cantilever spring" is used to describe a beam or leaf spring with one end (the anchored end 16*a*) constrained more than the opposite end (the deflection end 18*a*). For example, the anchored end 16*a* can move as the cantilever spring 12*a* moves or displaces along the path of travel P, but is limited to movement along the path of travel while the deflection end 18*a* deflects or bends.

The module 10 can include a connection 20 to operatively couple the cantilever spring and non-planar contact surface to the exercise machine. The connection 20 can include a yoke 22 and a pin 24 which can engage a cable 26 coupled to or associated with the exercise machine. The yoke 22 can be coupled to either the cantilever spring or the non-planar contact surface, or associated components as described below. The connection 20 is one example of means for operatively coupling at least one of the cantilever spring and the non-planar contact surface to an exercise machine. The means for coupling the spring and/or contact surface to an exercise machine can include a variety of configurations.

The non-planar contact surface 14*b* and cantilever spring 12*a* can each be operatively restrained by at least one guide rail 28, which can define the path of travel P. One or both of the cantilever spring 12*a* and non-planar contact surface 14*b* can move along the guide rail 28. While not so limited, in one aspect of the invention, the path of travel P can include a substantially linear path, as the case would be when the guide rails limit movement of the contact surface and the spring to linear, movement along the guide rails.

In the embodiment shown in FIGS. 1 and 2, a pair of opposing crossheads 30*a* and 30*b* can be moveable with respect to each other along the path of travel P. One or both of the pair of opposing crossheads can move along the guide rail 28. The non-planar contact surface 14*b* can be associated with or carried by one of the crossheads 30*b*. The cantilever springs 12*a* can be associated with or carried by another of the pair of opposing crossheads 30*a*. In addition, the connection 20 can be coupled to one of the crossheads 30*a*.

The module 10 can include a plurality of cantilevered springs and a plurality of non-planar contact surfaces operatively paired together. Pairing the springs and contact surfaces can balance forces. For example, the springs and contact surfaces can be paired to oppose one another, such as with opposite cantilever springs 12*a* and 12*b* and opposing non-planar contact surfaces 14*a* and 14*b*. A first cantilever spring 12*a* can be coupled to a first non-planar contact surface 14*a* with the first cantilever spring 12*a* engaging a second non-planar contact surface 14*b* opposite the first contact surface 14*a*. A second cantilever spring 12*b* can be coupled to the second non-planar contact surface 14*b* and can engage the first contact surface 14*a*. Thus, the springs and contact surfaces are paired to engage one another. As another example, another pair can be provided similar to the first pair, and can include third and fourth cantilevered springs 12*c* and 12*d*, and third and fourth non-planar contact surfaces 14*c* and 14*d* with similar configurations. Thus, the first and third springs 12*a* and 12*c* can be paired together along with the first and third contact surfaces 14*a* and 14*c*. The first and third springs 12*a* and 12*c* can bend in opposite directions to balance the forces. The cantilever springs can thus provide a substantially constant compressive resistance force between the crossheads in response to relative movement of the crossheads along the path of travel.

The crossheads 30*a* and 30*b* can be associated with a pair of parallel guide rails 28 in a variety of manners known to those skilled in the art. In the embodiments shown, the crossheads can include linear bearings (not shown) through which the guide rails are disposed. The linear bearings can allow the crossheads to move relative to the guide rails with very little resistance. Similarly, the non-planar contact surfaces and the cantilever springs can be formed from a variety of materials known to those skilled in the art. In one aspect of the invention, the cantilever beams are formed of a blue tempered and polished 1095 spring steel with Rockwell C Hardness of about 48 to 50. The system has been successfully incorporated into a PowerFlex Model GGSY29210, manufactured by Icon Corporation of Utah. In this application, the system was measured to have an output, or resistance, force of about 418 N through a displacement of about 13.3 cm.

Figure 3:
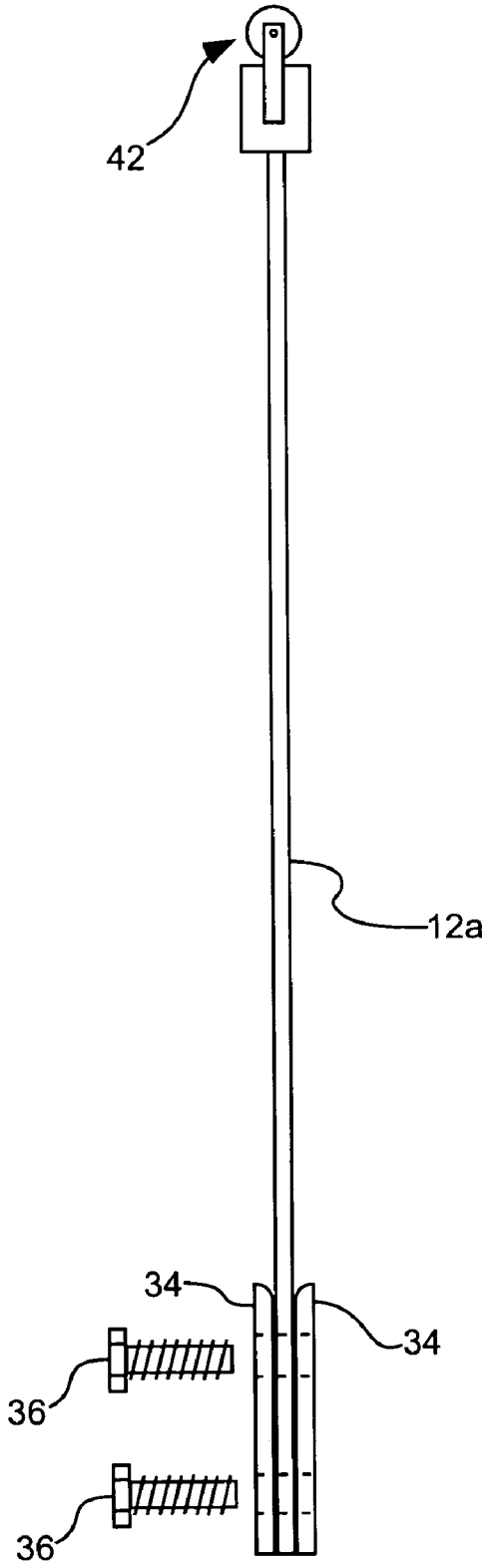
FIG. 3 is a front view of a cantilever spring assembly in accordance with an aspect of the invention.

The cantilever spring 12*a* and non-planar contact surface 14*b* can be disposed within the system in a variety of manners. As best shown in FIG. 3, in one aspect of the invention, the cantilever springs can be held between two shoulder plates 34 which can secure the spring in connection with bolts 36 inserted through the shoulder plates, through the spring, and into supporting structure of the resistance module. As shown in FIGS. 1 and 2, the non-planar contact surfaces can be secured to faces of the crossheads 30 via bolts 38, or via a variety of connection means known to those in the art. In one aspect of the invention, a first cantilever spring 12*a* is coupled to a first non-planar contact surface 14*a* and opposes a second cantilever spring 12*b* coupled to a second non-planar contact surface 14*b*. In this aspect, a deflection end 18*a* of the first cantilever spring can be engagable with the second non-planar contact surface 14*b* and a deflection end 18*b* of the second cantilever spring can be engagable with the first non-planar contact surface 14*a*.

The deflection end 18 of the cantilever springs 12 can engage and track along the non-planar contact surfaces 14 in a variety of manners. In the embodiment illustrated in FIGS. 1 and 2, a slidable bearing 40 can be coupled to or disposed on the end of the cantilever spring. In the aspect shown in FIG. 3, a roller bearing 42 can be disposed on or coupled to the end of the spring. In each case, the bearing aids in reducing drag between the spring and the contact surface to improve efficiency of the resistance module.

As illustrated in FIG. 1, the system can include a pair of opposing resistance modules disposed in an opposite orientation with respect to each other. For example, a pair of opposite cantilever springs 12*a*, 12*b* can be disposed in opposite orientation to a pair of opposing non-planar contact surfaces 14*a*, 14*b*. In this manner, the system can be optimized to cooperatively utilize the resistance force of a first resistance module in connection with a second, substantially equal resistance module opposing the first module.

Figure 5:
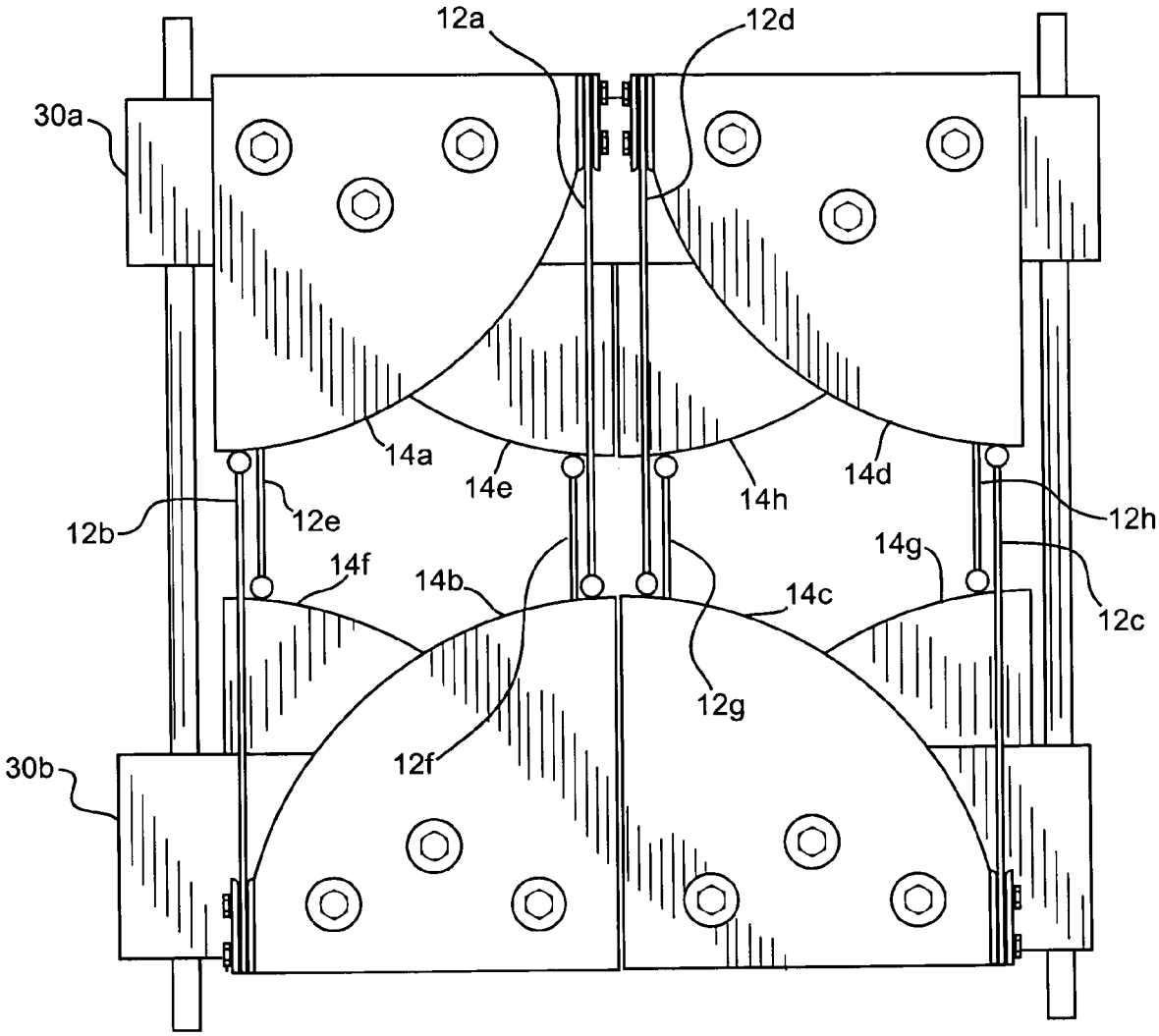
FIG. 5 is a front view of a substantially constant force resistance module in accordance with another embodiment of the present invention.

As shown in FIG. 5, in one aspect of the invention the system can include a total of eight resistance modules. In this embodiment, a first two pairs of resistance modules can be disposed in opposing orientation with respect to each other. Set 12*a*, 14*a* and set 12*b*, 14*b* can constitute a first pair of the first two pairs of resistance modules, while set 12*c*, 14*c* and 12*d*, 14*d* can constitute a second pair of the first two pairs of resistance modules. Thus, each of the two pairs of modules includes four non-planar contact surfaces and four cantilever springs, as shown by example with the first two pairs including non-planar contact surfaces 14*a*, 14*b*, 14*c* and 14*d*, and cantilever springs 12*a*, 12*b*, 12*c* and 12*d*. Each of these components of the first two pairs of modules can be disclosed in a first layer. In the example shown, the first layer of modules is disposed in front of crossheads 30*a* and 30*b*.

In addition, the system can include a second two pairs of resistance modules disposed in opposing orientation with respect to each other. Set 12*e*, 14*e* and set 12*f*, 14*f* can constitute a first pair of the second two pairs of resistance modules while set 12*g,* 14*g* and 12*h,* 14*h* can constitute a second pair of the second two pairs of resistance modules. It will be appreciated that each two pairs includes four non-planar contact surfaces and four cantilever springs, as shown by example with the second two pairs including non-planar contact surfaces 14*e,* 14*f,* 14*g* and 14*h,* and cantilever springs 12*e,* 12*f,* 12*g* and 12*h*. Each of these components of the second two pairs can be disclosed in a second layer. In the example shown, the second layer of modules is disposed in back of crossheads 30 and 30*b*. The second layer of modules can thus be oriented parallel and adjacent to the first layer of modules.

Although the modules are shown having a vertical path of travel P, it is understood that the modules could be oriented to have a horizontal or even angled path of travel. In addition, while some of the non-planar contact surfaces are shown as separate (14*b* and 14*d*), it is understood that the contact surfaces could be a single, continuous surface.

In one aspect of the invention, the cantilever spring 12 can apply a force to the non-planar contact surface 14 that varies in angle with respect to the path of travel P as the deflection end 18 of the spring tracks along the non-planar contact surface. For example, as the cantilever spring and non-planar contact surface initially begin travel, a force $F_1$ (FIG. 1) is initially applied to the non-planar contact surface 14*b* by end 18*a* of spring 12*a* in a direction substantially parallel to the path of travel P. After the spring and non-planar contact surface have traveled some distance toward each other, as shown in FIG. 2, the force $F_2$ applied to the contact surface by the spring is formed at an angle with respect to the path of travel P. The angle can range in magnitude and in one embodiment is an acute angle. Thus, the force has a component parallel with the path of travel, and a component orthogonal to the path of travel. As the spring bends, the resistance force provided by the spring itself varies or increases, while the component of the force parallel with the path of travel remains substantially constant.

As shown in FIGS. 1 and 2, the non-planar contact surface 14*c* can include an arcuate surface. In one aspect of the invention, the non-planar contact surface can include a circular surface having a substantially constant radius R of curvature through at least 45 degrees. In the embodiment shown, the magnitude of the substantially constant resistance force provided by the module can be represented by the equation $F=0.105\ Eth^3/L^2$, which has been found to vary less than about three percent (3%) over a deflection (d, FIG. 2) ranging more than about sixty percent (60%) of the cantilever spring length. In the force equation given, E=Young's modulus of the spring, t=thickness of the cantilever spring (FIG. 1), h=width of the cantilever spring (into the plane of FIG. 1), and L=length of the cantilever spring (FIG. 1). In one aspect of the invention the values of the variables were as follows: R=21.6 cm, L=28.8 cm, h=5.08 cm, t=0.1575 cm, and E=207 GPa.

Figure 4:
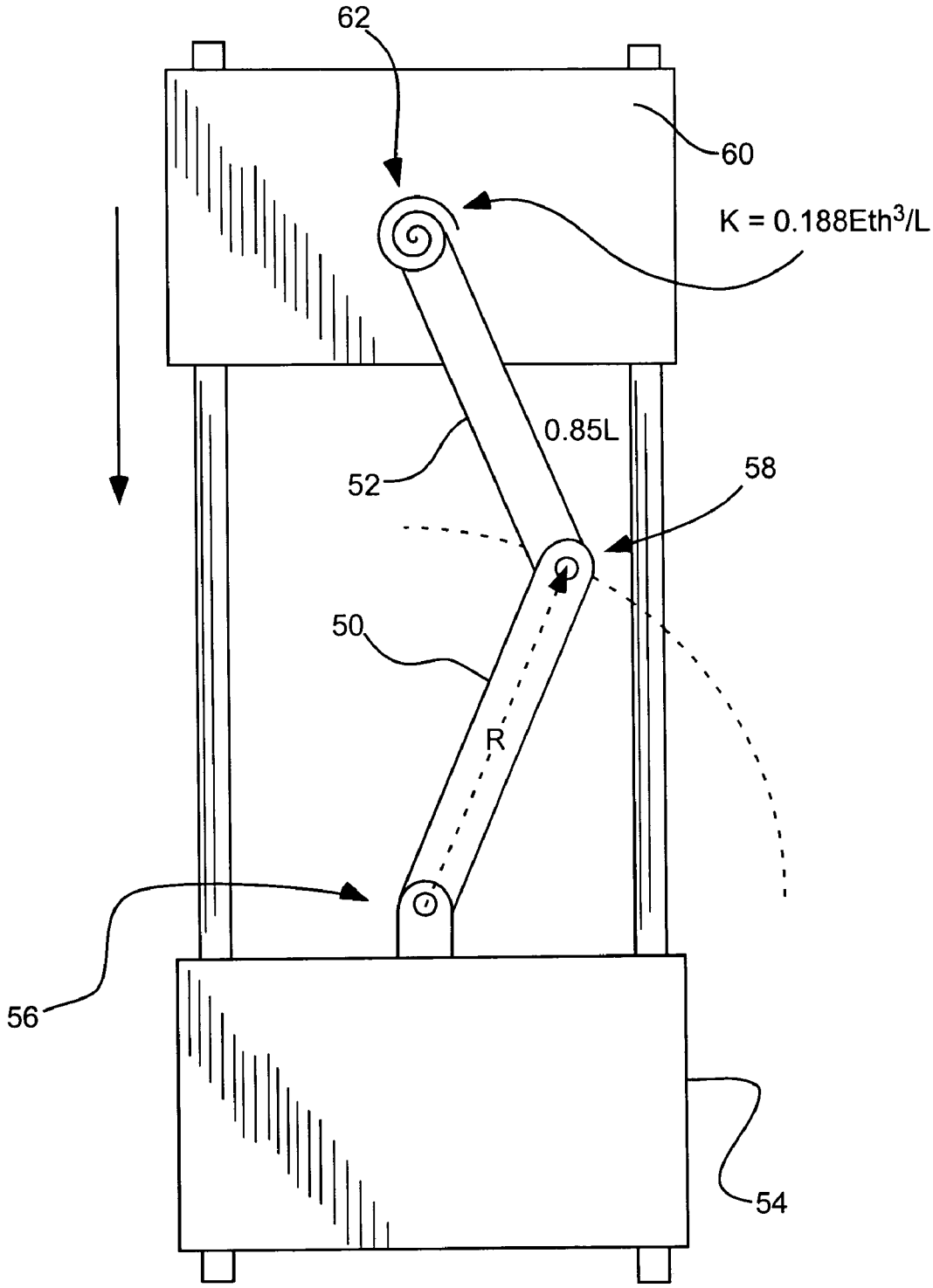
FIG. 4 is a front view of an exemplary pseudo-rigid body model of a beam spring in accordance with an aspect of the invention.

Turning now to FIG. 4, a pseudo-rigid body that has been found to accurately predict the relatively large deflection motion of the cantilever spring is shown. The model includes a first rigid link 50 and second rigid link 52. The first rigid link can be pivotally coupled to crosshead 54 at pinned connection 56. The second rigid link can be pivotally coupled to the first link at pinned connection 58. The second rigid link can be pivotally coupled to crosshead 60 via torsional spring 62. Assuming the torsional spring has a spring constant $K=0.188\ Eth^3/L$, the model is optimized with the non-dimensional length ratio of R/L=0.753.

Figure 6:
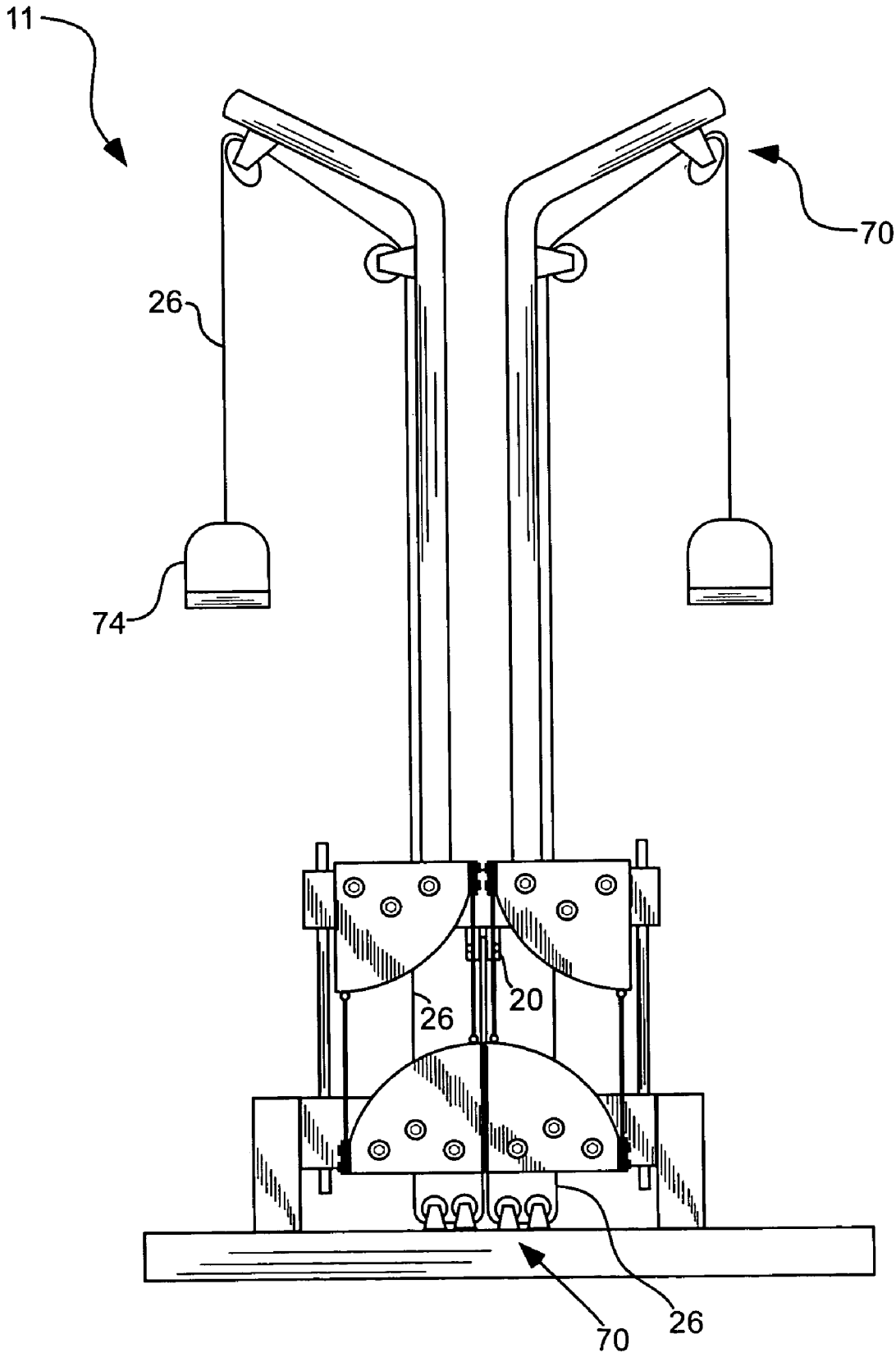
FIG. 6 is a front view of the resistance module of FIG. 5 incorporated into an exercise machine.

Referring to FIG. 6, the modules 10 are shown incorporated with an exercise machine 11. The exercise machine can have various different connections and operative components. As shown, the exercise machine can utilize a pulley system 70 to operatively couple an active element, such as hand grip 74, to the modules 10. Thus, a user can pull on the hand grip 70, which pulls the cable 26 through the pulley system 70 and displaces the cantilever springs and non-planar contact surfaces of the modules towards one another. It is understood that various different active elements can be used, such as foot grips, bars, leg or arm curls, etc.

Figure 7:
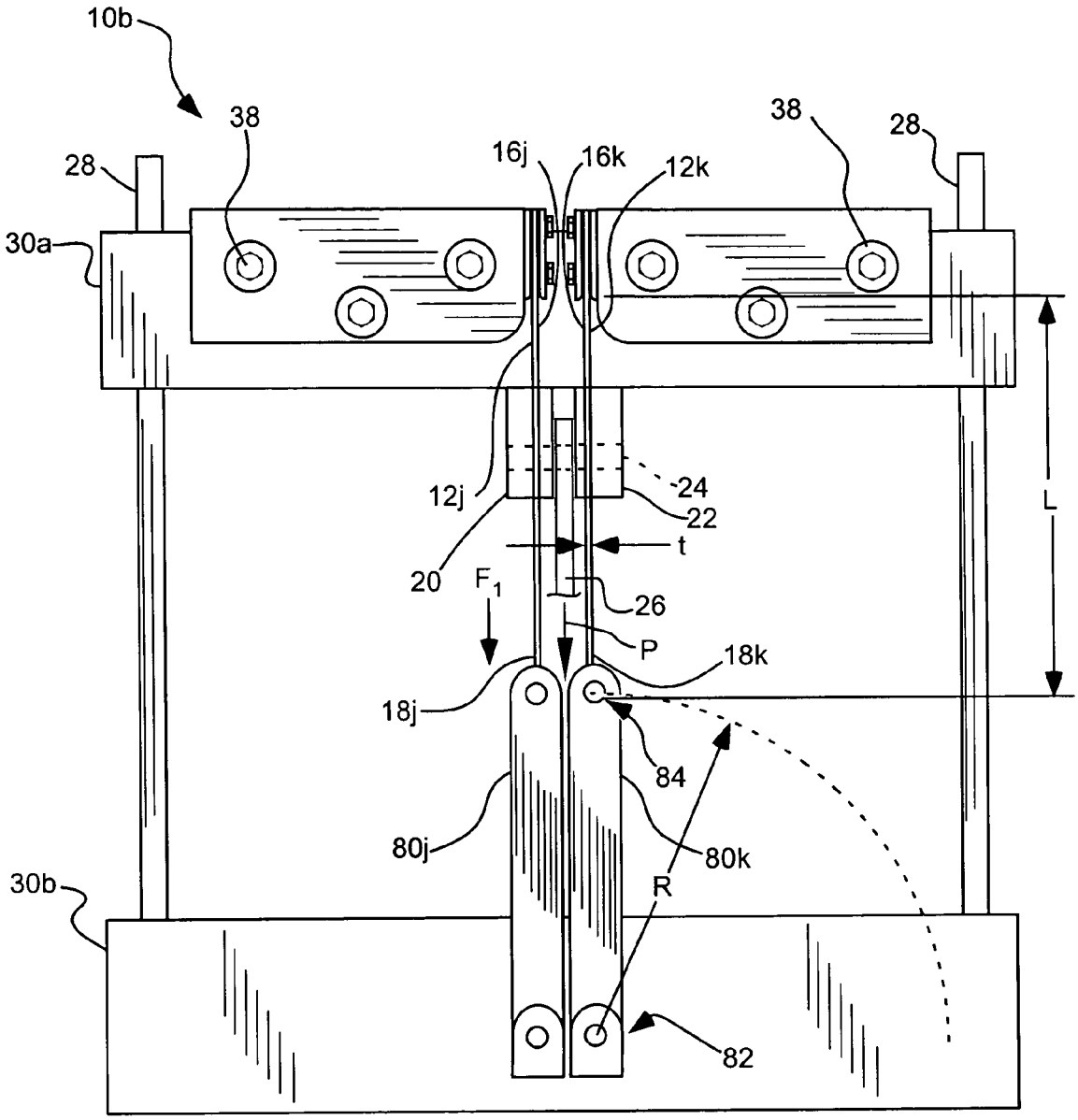
FIG. 7 is a front view of another resistance module in accordance with an embodiment of the invention.
Figure 8:
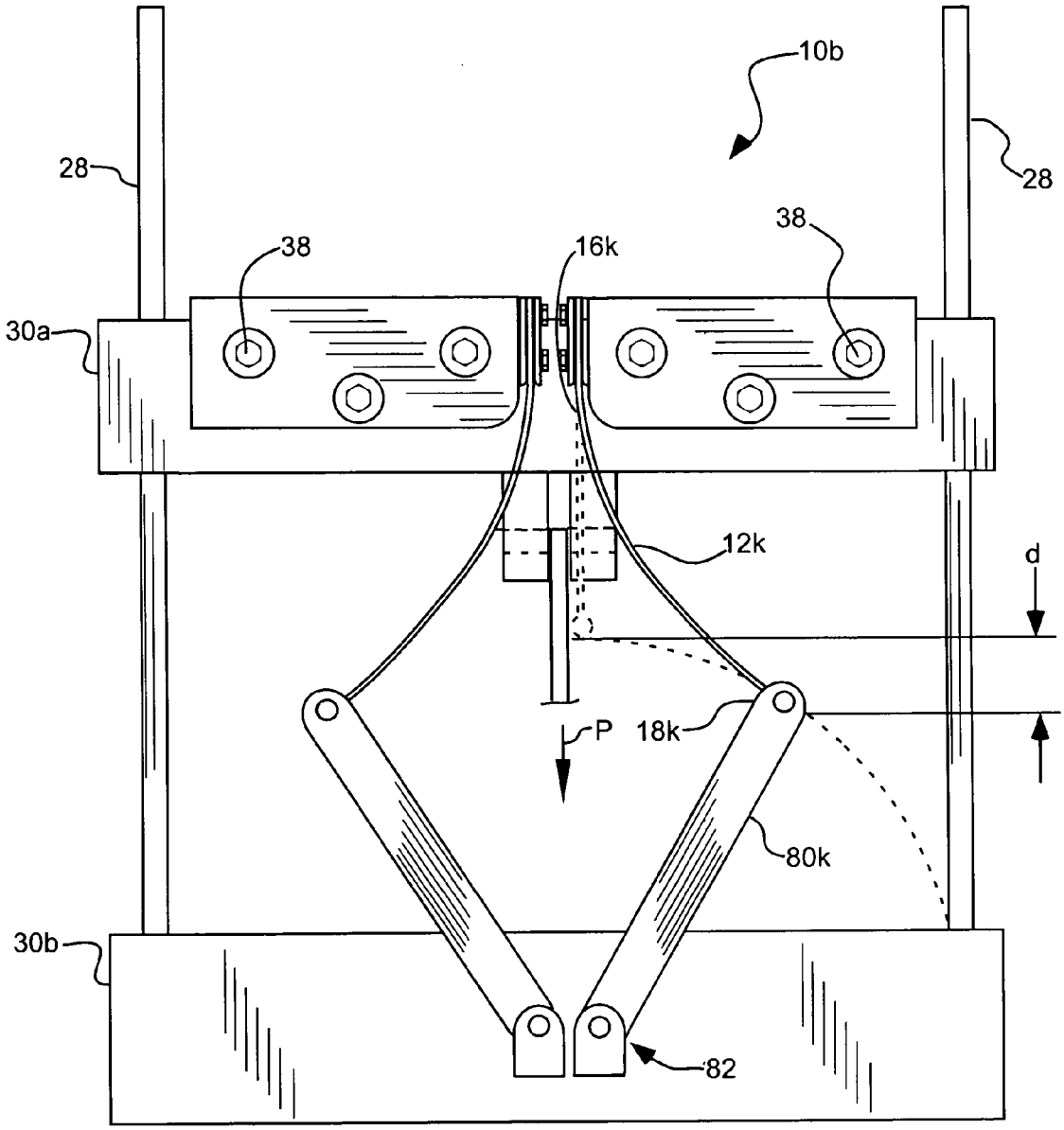
FIG. 8 is a front view of the resistance module of FIG. 7 in a displaced configuration.

Turning now to FIGS. 7 and 8, another embodiment of the present invention is shown for a resistance module 10*b* configured for use in an exercise machine. The module 10*b* can be similar in many respects to those described above. The module 10*b* can include one or more cantilever springs 12*j* and 12*k,* and one or more pivot links 80*j* and 80*k*. The pivot links can form the rigid member described above. The cantilever springs 12*j* and 12*k* can each have an anchored end 16*j* and 16*k,* respectively, and a deflecting end 18*j* and 18*k,* respectively. The pivot links 80*j* and 80*k* can have a pivot end 82 pivotally coupled to crosshead 30*b,* and an opposite moving end 84 pivotally coupled to the deflecting end 18*j* and 18*k* of the cantilever spring. The pivot link is configured to pivot about end 82 to define an arcuate path of deflection of the other end 84 having a radius R. As shown in displaced configuration in FIG. 8, as the crosshead 30*a* moves relative to crosshead 30*b,* the pivot links 80*j* and 80*k* cause the cantilever springs 12*j* and 12*k* to deflect and produce a resistance force as the cantilever springs and the pivot links move with respect to one another along the path of travel. The pivot links 80*j* and 80*k* engage the deflection ends 18*j* and 18*k* of the cantilever springs, and constrain the deflection ends to a predetermined path of deflection.

The present invention also includes a method for utilizing the structure detailed above for providing a substantially constant force through a range of motion for exercising. The method can include the steps of: pulling an active member of an exercise machine through the range of motion; deflecting a deflection end of at least one cantilever spring through a path of deflection in response to pulling of the active member to produce a resistance force; separating the resistance force produced by the at least one cantilever spring into i) a first component that is substantially constant through the path of deflection, and ii) a second component that is substantially non-constant through the path of deflection; and operatively coupling only the first component of the resistance force produced by the at least one cantilever spring to the active member of the exercise machine.

The method can also include the steps of: displacing at least one of a cantilever spring and a non-planar contact surface relative to each other in a substantially linear path of travel in response to pulling of the active member; and changing an angle of a force applied to the non-planar contact surface by a deflection end of the cantilever spring from a direction substantially collinear with the linear path of travel to a direction at an acute angle to the linear path of travel.

The method can include the further step of displacing at least one of a second cantilever spring and a second non-planar contact surface relative to each other in the line of travel. The at least one cantilever spring and non-planar contact surface can comprise a resistance module, and the method can comprise the further steps of: disposing two pairs of resistance modules in opposing orientation with respect to each other, and orienting the two pairs in a first plane; and disposing a second two pairs of resistance modules in opposing orientation with respect to each other, and orienting the second two pairs in a second plane parallel and adjacent to the first plane. The method can include the further step of disposing the second two pairs of resistance modules behind the two pairs of resistance modules.

It is to be understood that the above-referenced arrangements are illustrative of the application for the principles of the present invention. It will be apparent to those of ordinary skill in the art that numerous modifications can be made without departing from the principles and concepts of the invention as set forth in the claims.

What is claimed is:

1. A resistance module configured for an exercise machine for providing a substantially constant force through a range of motion, comprising:

at least one cantilever spring and at least one rigid member movable with respect to one another along a path of travel with the at least one rigid member causing the at least one cantilever spring to deflect and produce a resistance force as the at least one cantilever spring and the at least one rigid member move with respect to one another along the path of travel;

the cantilever spring having an anchored end and a deflection end;

the at least one rigid member engaging the deflection end of the cantilever spring, and constraining the deflection end to a predetermined path of deflection as the at least one cantilever spring and the at least one rigid member move with respect to one another;

means for operatively coupling at least one of the cantilever spring and the at least one rigid member to an exercise machine; and an active element engageable by a user and operatively coupled to the resistance module.

2. A module in accordance with claim 1, wherein the at least one rigid member separates the resistance force produced by the at least one cantilever spring into i) a first component that is substantially constant through the path of deflection, and ii) a second component that is substantially non-constant through the path of deflection; and wherein the means for operatively coupling operatively couples only the first component of the resistance force produced by the at least one cantilever spring to the exercise machine.

3. A module in accordance with claim 1, wherein the path of travel is substantially linear.

4. A module in accordance with claim 1, wherein:

the rigid member includes at least one non-planar contact surface;

the deflection end of the cantilever spring is engagable with, and tracks along, the non-planar contact surface as the cantilever spring and the non-planar contact surface move with respect to one other along the path of travel; and the cantilever spring is bendable as the deflection end tracks along the non-planar contact surface to produce the substantially constant resistance force in a direction of the path of travel as the cantilever spring and the non-planar contact surface move with respect to one other along the path of travel.

5. A module in accordance with claim 4, further comprising a pair of opposing resistance modules disposed in an opposite orientation with respect to each other, including a pair of opposite cantilever springs and a pair of opposing non-planar contact surfaces.

6. A module in accordance with claim 5, wherein a first cantilever spring is coupled to a first non-planar contact surface and opposes a second cantilever spring coupled to a second non-planar contact surface, with a deflection end of the first cantilever spring engagable with the second non-planar contact surface and a deflection end of the second cantilever spring engagable with the first non-planar contact surface.

7. A module in accordance with claim 4, further comprising:

two pairs of resistance modules disposed in opposing orientation with respect to each other and being oriented in a first layer; and a second two pairs of resistance modules disposed in opposing orientation with respect to each other and being oriented in a second layer parallel and adjacent to the first layer.

8. A module in accordance with claim 7, wherein the second two pairs of resistance modules are disposed behind the two pairs of resistance modules.

9. A module in accordance with claim 4, wherein the cantilever spring applies a force to the non-planar contact surface that varies in angle with respect to the linear path of travel as the deflection end of the spring tracks along the non-planar contact surface.

10. A module in accordance with claim 4, further comprising a slidable bearing disposed on the deflection end of the cantilever spring.

11. A module in accordance with claim 4, further comprising a rolling bearing coupled to the deflection end of the cantilever spring.

12. A module in accordance with claim 4, wherein the non-planar contact surface includes an arcuate surface.

13. A module in accordance with claim 4, wherein the non-planar contact surface includes a circular surface having a substantially constant radius of curvature through at least 45 degrees.

14. A module in accordance with claim 1, wherein:

the rigid member includes at least one pivot link having a moving end and a pivot end;

the deflection end of the cantilever spring is pivotally coupled to the moving end of the pivot link; and the cantilever spring being bendable and the pivot link being pivotal as the cantilever spring and the pivot link move with respect to one other along the path of travel.

15. A resistance module configured for an exercise machine for providing a substantially constant force through a range of motion, comprising:

at least one cantilever spring and at least one rigid member, each being operatively restrained by at least one guide rail along a substantially linear path of travel with respect to one another;

the at least one rigid member causing the at least one cantilever spring to deflect and produce a resistance force as the at least one cantilever spring and the at least one rigid member move with respect to one another along the linear path of travel;

the cantilever spring having an anchored end and a deflection end;

the at least one rigid member engaging the deflection end of the cantilever spring, and constraining the deflection end to a predetermined path of deflection as the at least one cantilever spring and the at least one rigid member move with respect to one another; and an active element engageable by a user and operatively coupled to the resistance module.

16. A module in accordance with claim 15, further comprising:

means for operatively coupling at least one of the cantilever spring and the at least one rigid member to an exercise machine.

17. A module in accordance with claim 16, wherein the at least one rigid member separates the resistance force produced by the at least one cantilever spring into i) a first component that is substantially constant through the path of deflection, and ii) a second component that is substantially non-constant through the path of deflection; and wherein the means for operatively coupling operatively couples only the first component of the resistance force produced by the at least one cantilever spring to the exercise machine.

18. A module in accordance with claim 15, wherein:

the rigid member includes at least one non-planar contact surface;

the deflection end of the cantilever spring is engagable with, and tracks along, the non-planar contact surface as the cantilever spring and the non-planar contact surface move with respect to one other along the path of travel; and the cantilever spring is bendable as the deflection end tracks along the non-planar contact surface to produce the substantially constant resistance force in a direction of the path of travel as the cantilever spring and the non-planar contact surface move with respect to one other along the path of travel.

19. A module in accordance with claim 18, further comprising a pair of opposing resistance modules disposed in an opposite orientation with respect to each other, including a pair of opposite cantilever springs and a pair of opposing non-planar contact surfaces.

20. A module in accordance with claim 19, wherein a first cantilever spring is coupled to a first non-planar contact surface and opposes a second cantilever spring coupled to a second non-planar contact surface, with a deflection end of the first cantilever spring engagable with the second non-planar contact surface and a deflection end of the second cantilever spring engagable with the first non-planar contact surface.

21. A module in accordance with claim 18, further comprising:

two pairs of resistance modules disposed in opposing orientation with respect to each other and being oriented in a first layer; and a second two pairs of resistance modules disposed in opposing orientation with respect to each other and being oriented in a second layer parallel and adjacent to the first layer.

22. A module in accordance with claim 21, wherein the second two pairs of resistance modules are disposed behind the two pairs of resistance modules.

23. A module in accordance with claim 18, wherein the cantilever spring applies a force to the non-planar contact surface that varies in angle with respect to the linear path of travel as the deflection end of the spring tracks along the non-planar contact surface.

24. A module in accordance with claim 18, further comprising a slidable bearing disposed on the deflection end of the cantilever spring.

25. A module in accordance with claim 18, further comprising a rolling bearing coupled to the deflection end of the cantilever spring.

26. A module in accordance with claim 18, wherein the non-planar contact surface includes an arcuate surface.

27. A module in accordance with claim 18, wherein the non-planar contact surface includes a circular surface having a substantially constant radius of curvature through at least 45 degrees.

28. A module in accordance with claim 15, wherein:

the rigid member includes at least one pivot link having a moving end and a pivot end;

the deflection end of the cantilever spring is pivotally coupled to the moving end of the pivot link; and the cantilever spring is bendable and the pivot link is pivotal as the cantilever spring and the pivot link move with respect to one other along the path of travel.

29. A resistance module configured for an exercise machine for providing a substantially constant force through a range of motion, comprising:

a pair of opposing crossheads moveable with respect to each other along a path of travel;

at least one guide rail along which at least one of the pair of opposing crossheads moves along the path of travel;

at least one rigid member, associated with one of the pair of opposing crossheads;

at least one cantilever spring, associated with another of the pair of opposing crossheads and engagable with the at least one rigid member as the pair of opposing crossheads move with respect to one another, the cantilever spring providing a substantially constant compressive resistance force between the crossheads in response to relative movement of the crossheads along the path of travel; and an active element engageable by a user and operatively coupled to the resistance module.

30. A module in accordance with claim 29, further comprising:

means for operatively coupling at least one of the crossheads to an exercise machine.

31. A module in accordance with claim 30, wherein the at least one rigid member separates the resistance force produced by the at least one cantilever spring into i) a first component that is substantially constant through the path of deflection, and ii) a second component that is substantially non-constant through the path of deflection; and wherein the means for operatively coupling operatively couples only the first component of the resistance force produced by the at least one cantilever spring to the exercise machine.

32. A module in accordance with claim 29, wherein:

the rigid member includes at least one non-planar contact surface;

the deflection end of the cantilever spring is engagable with, and tracks along, the non-planar contact surface as the pair of opposing crossheads moves along the path of travel; and the cantilever spring is bendable as the deflection end tracks along the non-planar contact surface to produce the substantially constant resistance force in a direction of the path of travel as the pair of opposing crossheads moves along the path of travel.

33. A module in accordance with claim 32, wherein the cantilever spring applies a force to the non-planar contact surface that varies in angle with respect to the path of travel as the deflection end of the spring tracks along the non-planar contact surface.

34. A method for providing a substantially constant force through a range of motion for exercising, comprising the steps of:

pulling an active member of an exercise machine through the range of motion;

deflecting a deflection end of at least one cantilever spring through a path of deflection in response to pulling of the active member to produce a resistance force and displacing at least one of the cantilever spring and a rigid member relative to each other in a substantially linear path of travel in response to pulling of the active member;

separating the resistance force produced by the at least one cantilever spring into i) a first component that is substantially constant through the path of deflection, and ii) a second component that is substantially non-constant through the path of deflection; and operatively coupling only the first component of the resistance force produced by the at least one cantilever spring to the active member of the exercise machine.

35. A method in accordance with claim 34, further comprising the step of:

changing an angle of a force applied to the rigid member by a deflection end of the cantilever spring from a direction substantially parallel with the linear path of travel to a direction at an acute angle to the linear path of travel.

36. A method in accordance with claim 34, wherein the step of displacing at least one of the cantilever spring and the rigid member relative to each other further includes displacing at least one of the cantilever spring and a pivoting link relative to each other in a substantially linear path of travel in response to pulling of the active member.

37. A method in accordance with claim 34, wherein the step of displacing at least one of the cantilever spring and the rigid member relative to each other further includes displacing at least one of the cantilever spring and a non-planar contact surface relative to each other in a substantially linear path of travel in response to pulling of the active member.

38. A method in accordance with claim 37, comprising the further step of displacing at least one of a second cantilever spring and a second non-planar contact surface relative to each other in the substantially linear path of travel.

39. A method in accordance with claim 37, wherein the at least one cantilever spring and non-planar contact surface comprise a resistance module, and comprising the further step of:

disposing two pairs of resistance modules in opposing orientation with respect to each other, and orienting the two pairs in a first plane; and disposing a second two pairs of resistance modules in opposing orientation with respect to each other, and orienting the second two pairs in a second plane parallel and adjacent to the first plane.

40. A method in accordance with claim 37, comprising the further step of disposing the second two pairs of resistance modules behind the two pairs of resistance modules.

41. A method in accordance with claim 37, wherein the non-planar contact surface includes an arcuate surface.

42. A method in accordance with claim 37, wherein the non-planar contact surface includes a circular surface have a substantially constant radius of curvature through at least 45 degrees.

* * * * *